US008069656B2

(12) United States Patent
Baird et al.

(10) Patent No.: US 8,069,656 B2
(45) Date of Patent: Dec. 6, 2011

(54) METHOD OF CONTROLLING HYDROCARBON ACCUMULATION IN A PARTICULATE FILTER UNDER CERTAIN OPERATING CONDITIONS

(75) Inventors: Matthew T. Baird, Canton, MI (US); Amr M. Radwan, Canton, MI (US); Kevin D. Sisken, Saline, MI (US); Bryant C. Pham, Canton, MI (US); Mark A. Zurawski, Northville, MI (US); Heather A. Staley, Garden City, MI (US)

(73) Assignee: Detroit Diesel Corporation, Detroit, MI (US)

( * ) Notice: Subject to any disclaimer, the term of this patent is extended or adjusted under 35 U.S.C. 154(b) by 794 days.

(21) Appl. No.: 12/118,235

(22) Filed: May 9, 2008

(65) Prior Publication Data

US 2009/0277158 A1 Nov. 12, 2009

(51) Int. Cl.
*F01N 3/00* (2006.01)

(52) U.S. Cl. ..... 60/286; 60/274; 60/285

(58) Field of Classification Search ..... 60/286
See application file for complete search history.

(56) References Cited

U.S. PATENT DOCUMENTS

| | | | | |
|---|---|---|---|---|
| 5,201,173 | A * | 4/1993 | Fujimoto et al. | 60/277 |
| 5,428,955 | A * | 7/1995 | Yuuki et al. | 60/276 |
| 6,594,990 | B2 * | 7/2003 | Kuenstler et al. | 60/295 |
| 7,054,734 | B2 * | 5/2006 | Todoroki et al. | 701/105 |
| 2004/0139739 | A1 * | 7/2004 | Kagenishi | 60/289 |
| 2004/0200271 | A1 * | 10/2004 | van Nieuwstadt | 73/118.1 |
| 2006/0218897 | A1 * | 10/2006 | Sisken et al. | 60/284 |
| 2006/0236680 | A1 * | 10/2006 | Zhang et al. | 60/286 |

FOREIGN PATENT DOCUMENTS

JP 2005083352 A * 3/2005

* cited by examiner

*Primary Examiner* — Kenneth Bomberg
*Assistant Examiner* — Jason Shanske
(74) *Attorney, Agent, or Firm* — Reising Ethington P.C.

(57) ABSTRACT

One embodiment of the invention includes a method of operating an internal combustion engine system comprising an engine, an oxidation catalyst, and a particulate filter, the method comprising: determining if the outlet temperature of exhaust gas from the oxidation catalyst is below a first temperature, measuring the time that the outlet temperature of exhaust gas from the oxidation catalyst is below the first temperature, determining if the measured time has exceeded a first time period, and if so, elevating the temperature of the exhaust gas exiting the oxidation catalyst.

14 Claims, 3 Drawing Sheets

METHOD OF CONTROLLING HYDROCARBON ACCUMULATION IN A PARTICULATE FILTER UNDER CERTAIN OPERATING CONDITIONS

TECHNICAL FIELD

The field to which the disclosure generally relates includes methods of controlling hydrocarbon accumulation in particulate filters or oxidation catalysts of a vehicle.

BACKGROUND

Internal combustion engine after-treatment systems utilizing a hydrocarbon doser rely on a certain level of exhaust temperature into the after-treatment components before hydrocarbons can be oxidized or combusted. The temperature level is typically determined by the inlet temperature to the after-treatment assembly.

SUMMARY OF EXEMPLARY EMBODIMENTS OF THE INVENTION

One embodiment of the invention includes a method of operating an internal combustion engine system comprising an engine, an oxidation catalyst, and a particulate filter, the method comprising: determining if the outlet temperature of exhaust gas from the oxidation catalyst is below a first temperature, measuring the time that the outlet temperature of exhaust gas from the oxidation catalyst is below the first temperature, determining if the measured time has exceeded a first time period, and if so, elevating the temperature of the exhaust gas exiting the oxidation catalyst.

Other exemplary embodiments of the invention will become apparent from the detailed description provided hereinafter. It should be understood that the detailed description and specific examples, while disclosing exemplary embodiments of the invention, are intended for purposes of illustration only and are not intended to limit the scope of the invention.

BRIEF DESCRIPTION OF THE DRAWINGS

Exemplary embodiments of the invention will become more fully understood from the detailed description and the accompanying drawings, wherein.

DETAILED DESCRIPTION OF EXEMPLARY EMBODIMENTS

The following description of the embodiment(s) is merely exemplary in nature and is in no way intended to limit the invention, its application, or uses.

Figure 1:
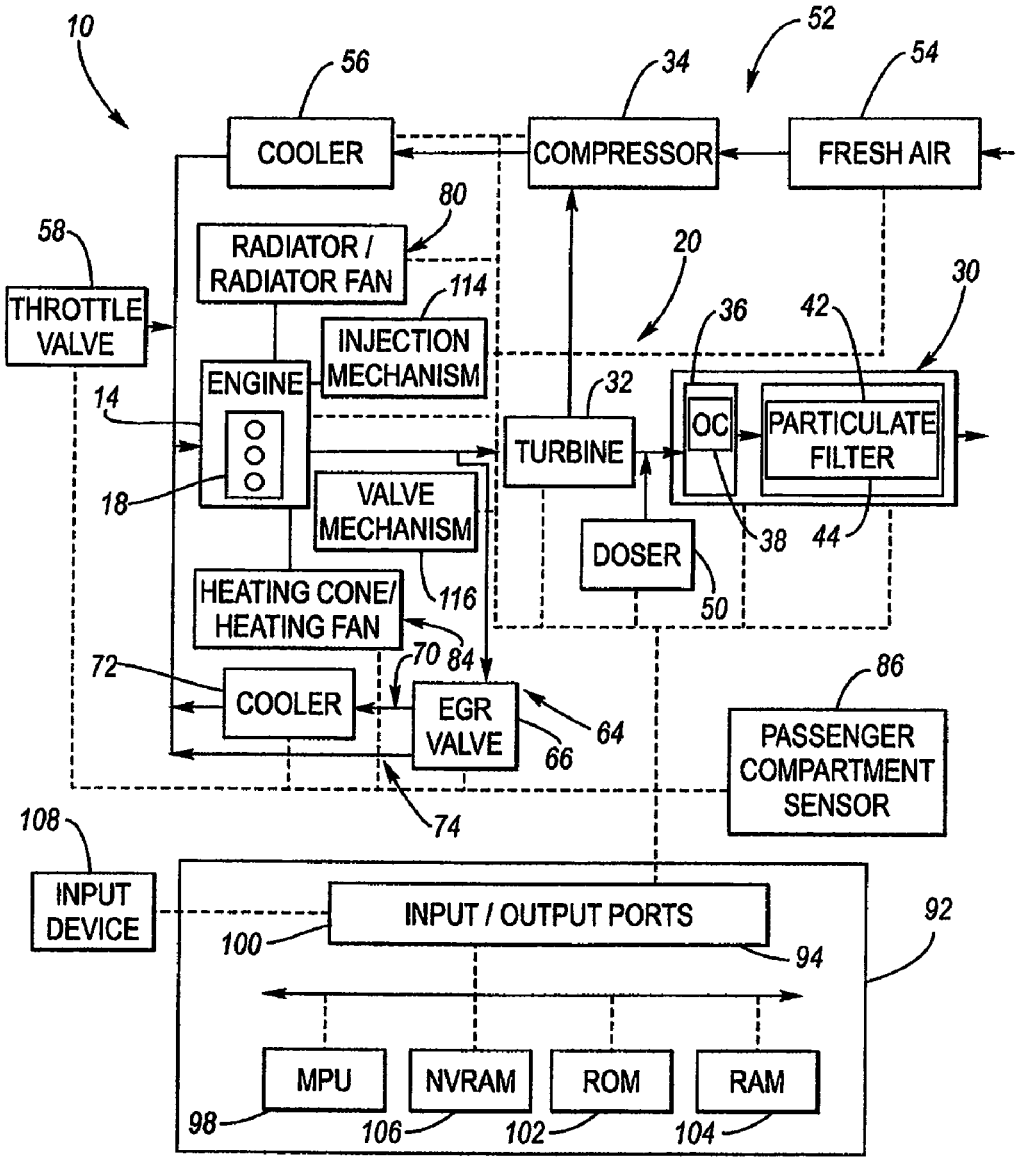
FIG. 1 is a schematic illustrative of one embodiment of a system useful in carrying out a method according to one embodiment of the invention.

FIG. 1 is a schematic illustrative of one embodiment of a product or vehicle powertrain system 10, the components of which may be useful in a method according to one embodiment of the invention. The system 10 may be utilized to provide power for vehicles, including but not limited to, on-highway trucks, construction equipment, marine vessels, stationary generators, automobiles, trucks, tractor-trailers, boats, recreation vehicles, light and heavy duty work vehicles, and the like.

The system 10 includes a combustion engine 14 which may be powered by any of a variety of fuels, including but not limited to gasoline or diesel fuels. The engine 14 may include a number of cylinders 18 into which the fuel and air are injected for ignition.

Exhaust gases generated by the combustion engine 14 exit the engine through the exhaust system 20. The exhaust system 20 may include a variety of components including an exhaust manifold and passageways to deliver the exhaust gases to a particulate filter assembly 30, which may be, but is not limited, to a diesel particulate filter. Optionally, the system 10 may include a turbocharger including a turbine 32 and a compressor 34 which may be a variable geometry turbocharger (VGT) and/or a turbo compound power turbine.

The particulate filter assembly 30 may be configured to capture particulates associated with the combustion process. The particulate filter assembly 30 may include an oxidation catalyst (OC) canister 36 which includes an OC 38, and a particulate filter canister 42 which includes a particulate filter 44. The canisters 36, 42 may be separate components joined together with a clamp or the canisters 36, 42 may be separately serviceable.

The OC 38 may be utilized to oxidize hydrocarbons and carbon monoxide present in the exhaust gases and the oxidation may result in an increase in the temperatures at the particulate filter 44. Particulate filter 44 may capture particulates present in the exhaust gases, such as carbon, oil particulates, ash and the like. The particulate filter 44 may be regenerated by burning or oxidizing the captured particulates if the temperatures of the particulate filter 44 or exhaust gases flowing therethrough are sufficiently high. As such, the particulates may be stored in the particulate filter 44 until such time as it is desired to oxidize the particulates by raising the temperature of the particulate filter at or above a predetermined temperature. The canisters 36, 42 may include inlets and outlets having defined cross-sectional areas with expansive portions therebetween to store the OC 38 and the particulate filter 44 respectively.

To facilitate oxidation of the captured particulates, a doser 50 may be included to inject fuel into the exhaust gases or onto the OC 38 such that the fuel reacts with the OC 38 and oxidizes or combusts to increase the temperature of the particulate filter 44 to burn off trapped particulates and regenerate the particulate filter 44 to a condition wherein it can capture substantially more particulates. The amount of fuel injected into the exhaust gases may be controlled as a function of the temperature of the particulate filter and other system parameters, such as mass airflow, exhaust gas recirculation temperatures, and the like so as to control the regeneration of the particulate filter.

An air intake system 52 may be included for delivering fresh air from a fresh air inlet 54 through an air passage to an air intake manifold for introduction of the same into the engine 14. The air intake system 52 may include a charged air cooler 56 to cool fresh air after it has been compressed by the compressor 34. A throttle intake valve 58 may be provided to control the flow of fresh air into the engine. A throttle valve 58 may be manually or electrically operated such as one in response to a pedal position of a throttle pedal operated by the driver of the vehicle.

An exhaust gas recirculation (EGR) system 64 may be provided to recycle exhaust gas to the engine 14 for mixing with the fresh intake air. The EGR system 64 may selectively introduce a metered portion of exhaust gases into the engine 14. For example, the EGR system 64 may be utilized to dilute the incoming fuel charge and low peak combustion temperatures to reduce the amount of oxides of nitrogen produced during combustion. The amount of exhaust gas to be recirculated may be controlled by controlling the EGR valve 66 and/or in combination with other components such as the turbocharger. The EGR valve 66 may be a variable flow valve that is electronically controlled.

The EGR system 64 may include an EGR cooler passage 70, which includes an air cooler 72 and an EGR non-cooler bypass 74. The EGR valve may be provided at the exhaust manifold to meter exhaust gas through one or both of the EGR cooler passage 70 or bypass 74.

A cooler system 80 may be provided for cooling the engine 14 by passing coolant therethrough. The coolant may be sufficient for fluidly conducting away heat generated by the engine 14, such as through a radiator. The cooling system 80 may be operated in conjunction with the heating system 84 which may include a heating cone, heating fan and heater valve. The heating cone may receive heated coolant fluid from the engine 14 through the heater valve so that the heating fan may be electronically controlled 86 by the occupant in the passenger area or cabin of the vehicle and may blow air warm by the heating core into the passenger area or cabin.

A controller 92, such as an electronic control module or engine control module, may be included in the system 10 to control various operations of the engine 14 and other system or subsystem components associated therewith, such as the sensors in the exhaust, EGR and intake systems. Various sensors may be in electrical communication with the controller via input/output ports 94. The controller 92 may include a microprocessor unit (MPU) 98 in communication with the various computer readable storage media via a data or control bus 100 or other communication technique. The computer readable storage media may include any one of a number of known devices which function as read only memory 102, random access memory 104, and non-volatile random access memory 106 or other media storage devices. A data, diagnostic, and programming input and output device 108 may also be selectively connected to the controller via a plug to exchange various information therebetween. The device 108 may be used to change values within the computer readable storage media, such as configuration settings, calibration variables, instructions for EGR, intake, exhaust system controls, doser controls and others.

The system 10 may also include an injector mechanism 114 for controlling fuel and/or air injection for the cylinders 18. The injection mechanism 114 may be controlled by the controller 92 or other controller and may comprise any number of functions, including controlling the injecting of fuel and/or air into a common-rail cylinder intake and a unit that injects fuel/or air into a cylinder individually.

The system may include a valve mechanism 116 for controlling the valve timing on the cylinders 18, such as to control airflow into an exhaust flow out of the cylinders 18. The valve mechanism 116 may be controlled by a controller 92 or other controller and may include a number of functions, including selectively and independently opening and closing cylinder intakes and/or exhaust valves. For example, the valve mechanism 116 may independently control the exhaust valve timing of each cylinders such that the exhaust and/or intake valves may be independently opened and closed at controllable intervals, such as with a compression brake.

In one embodiment, the controller 92 may be operated so as to receive signals from various engine/vehicle sensors and execute control logic embedded in the hardware and/software to control various components or the entire system 10. The computer readable storage memory may, for example, include instructions stored thereon that are executable by the controller 92 to perform methods of controlling various components and subsystems of the system 10. The program instructions may be executed by the controller and the MPU 98 to control the various systems and subsystems of the engine and/or vehicle through the input/output ports 94. In general, the dash line shown in FIG. 1 illustrates the optional sensing and control communication between the controller and the various components in the power system. Furthermore, it should be appreciated that any number of sensors or features may be associated with each component in the system for monitoring and controlling the operation thereof.

In one embodiment, the controller 92 may be a DDEC controller available from Detroit Diesel Corporation, Michigan, USA. Various other components of this controller are described in detail on a number of US patents assigned to Detroit Diesel Corporation. Further, the controller may include any of a number of programming and processing techniques or strategies to control any component of the system 10. The system 10 may include more than one controller, such as separate controllers for controlling system or subsystems, including an exhaust system controller to control exhaust gas temperature, mass flow rates, and other components and system parameters.

In one embodiment, the controller 92 or other component, such as a regeneration system controller, may be configured for determining a desired exhaust gas temperature of the exhaust gases exiting the engine to facilitate regeneration of the particulate filter 44 so that particulates captured by the particulate filter 44 are oxidized or otherwise burned. The regeneration of the particulate filter 44 in this manner prevents clogging and filling of the particulate filter 44 so that exhaust gases may pass therethrough with minimal restriction and yet permit additional particulates to be collected.

The desired exhaust gas temperature may be calculated to correspond with other factors and influences of the regeneration process. For example, the desired exhaust gas temperature is intended to refer to the temperature of exhaust gases emitted from the engine 14 that may be used alone or in combination with other control parameters or components to facilitate regeneration, such as in combustion with the temperature influence of the doser 50. The doser 50 may be constructed and arranged to inject a hydrocarbon such as gasoline or diesel fuel into the exhaust gas resulting in oxidation or combustion so that the temperature of downstream components such as the OC 38 and the particulate filter 44 raises. When the temperature of the exhaust gas is sufficiently high, the particulates trapped in the particulate filter 44 are oxidized or combusted.

Figure 2:
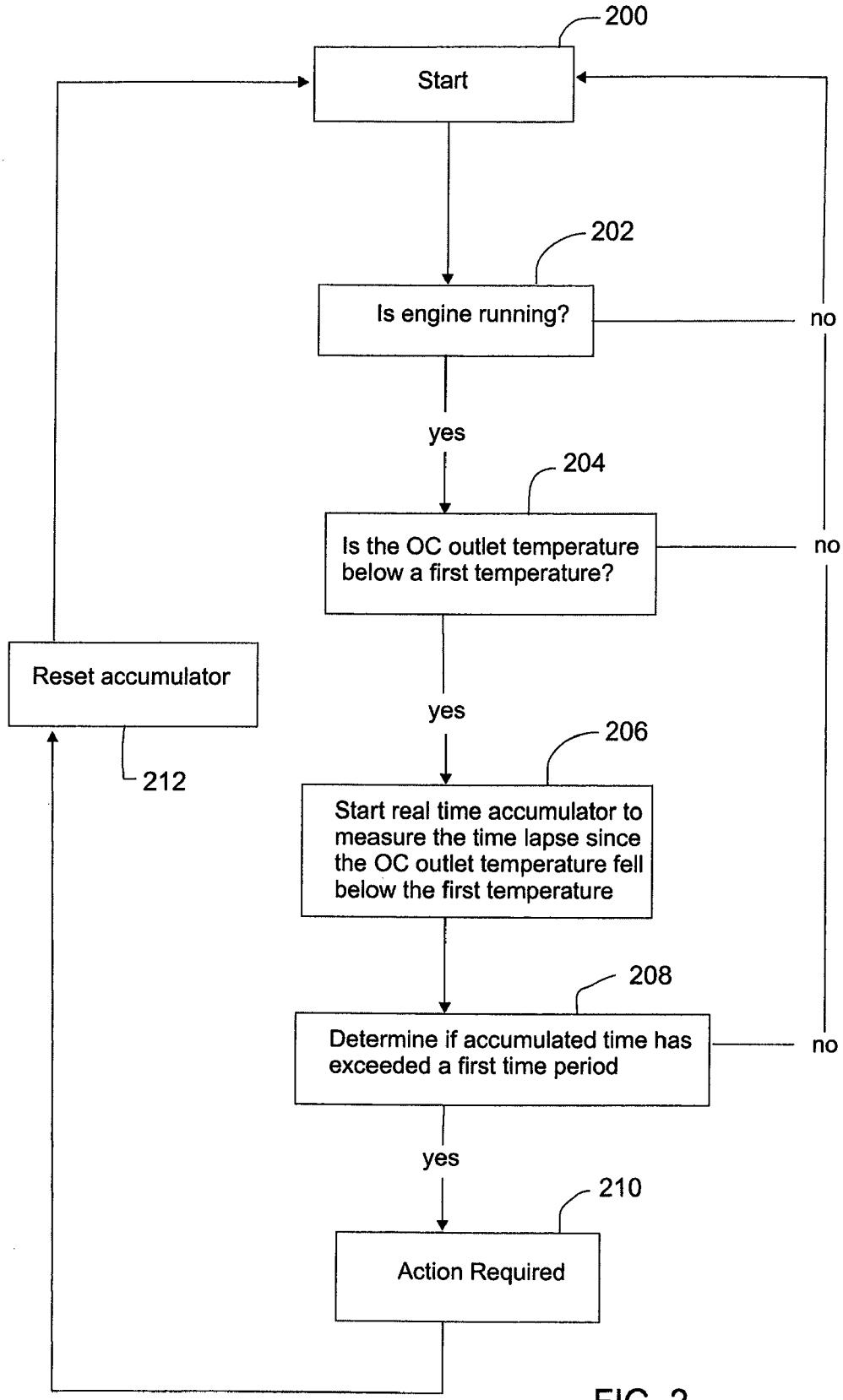
FIG. 2 is a flow chart illustrating a method according to one embodiment of the invention.

Referring now to FIG. 2, one embodiment of the invention includes a method of determining if action is required after the OC outlet temperature falls below a first temperature, for example the OC light-off temperature. Other temperatures could be compared to the first temperature that may indicate, or roughly indicate, the temperature of the OC 38 such as a temperature measured adjacent the particulate filter 44. Such a method may include a determination of whether or not the internal combustion engine is running 202. If the engine is running, a sub-determination may be made as to whether the engine speed is within a range indicative of the engine running in an idle operating mode.

If the engine is running, a determination may be made as to whether the OC outlet temperature or exhaust gases exiting therefrom are below a first temperature 204. If the OC outlet temperature or exhaust gases exiting therefrom are below the first temperature, a real time accumulator is started to measure the time lapse since the OC outlet temperature or exhaust gases exiting therefrom have fallen below the first temperature 206. The real time accumulator may be any accumulator, including those that sum numbers over time. For example, the real time accumulator could sum actual hydrocarbon or particulate matter rates over time. In this example, these values would then be compared to respective threshold or reference values. Referring back to FIG. 2, a determination is made as to whether or not the accumulated time since the OC outlet temperature or exhaust gases exiting therefrom have fallen below the first temperature has exceeded a first time period 208. For example, the first time period may be set anywhere from 10 hours to 45 hours. The exact rate of time accumulation may continuously vary and may depend on, but is not limited to, the engine's 14 particular operating mode or output characteristics of the exhaust gases. This means that in some embodiments the first time period can be exceeded at different times even though the value of the first time period may be the same. And the exact value of the first time period may depend on, but is not limited to, the rate of particulate accumulation which may vary with different engines and which itself may depend on the amount of unburned hydrocarbon that is emitted from the combustion engine 14, and may depend on the speed and load of the combustion engine. If the first time period has indeed been exceeded, then action may be required 210. In the above method, one thing that may be determined is whether particulates or hydrocarbon have been accumulated in the particulate filter assembly 30.

Figure 3:
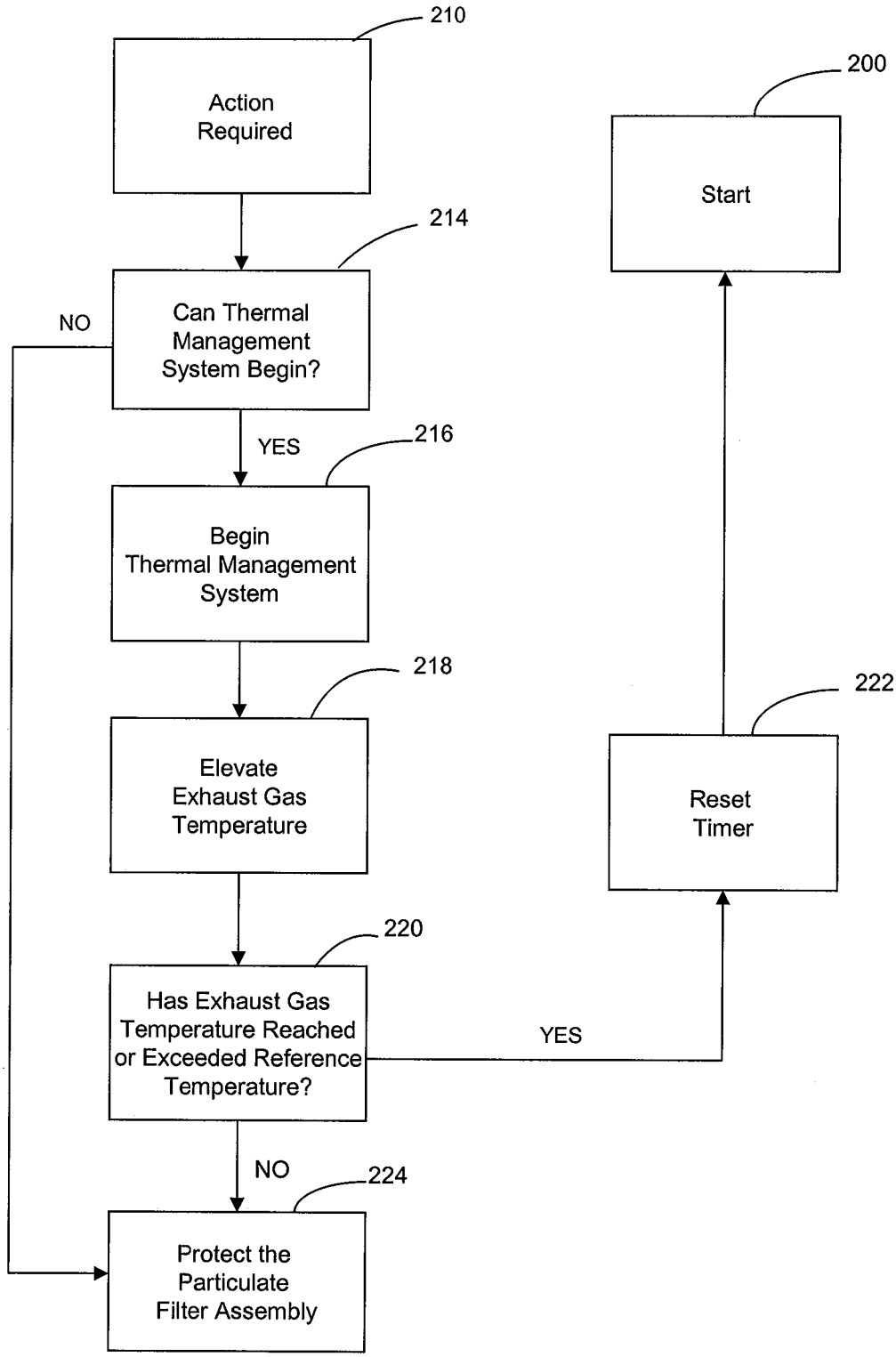
FIG. 3 is a flow chart illustrating a method according to one embodiment of the invention.

Referring to FIG. 3, once it is determined that particulates or hydrocarbon may have accumulated, then actions may be taken 210. For example, it may be first determined if a thermal management system can begin and can be turned on 214. The thermal management system may help to prevent additional particulates or hydrocarbon from accumulating, and may help to increase the temperature of the exhaust (in this example, the OC outlet temperature) to a degree where accumulated particulates or hydrocarbon can be oxidized, combusted, or both in the particulate filter assembly 30 and in the OC 38 (e.g., light-off temperature of the oxidation catalyst 38). In one example, the thermal management system may begin if, among other things, the current combustion engine load is below a predetermined load (indicating that the combustion engine is not undergoing excessive load), if the cooling temperature is above a predetermined cooling temperature, and checking a vehicle diagnostic system to determine if certain vehicle components are available in order to carry-out the thermal management operation and if certain engine conditions are met (e.g., checking engine speed, checking engine gear status, etc).

Once the thermal management system begins 216, the doser 50 may be prevented from injecting hydrocarbon into the exhaust gas. The doser 50 may continue to be prevented from injecting hydrocarbon after the OC outlet temperature is above a reference temperature for a predetermined time period; for example, the doser may be prevented for 4 minutes thereafter. The exact value of the predetermined time period may depend on, among other things, how long the combustion, oxidation, or both may sustain itself once ignited. Concurrently, any executing diagnostics that detect abnormal temperature increases in the particulate filter assembly 30 may be temporarily suspended since any accumulated particulates and hydrocarbon are being oxidized, combusted, or both.

After the accumulated time exceeds a second time period, the thermal management system may attempt to elevate the temperature of the exhaust gas 218 and thus of the OC outlet temperature. Attempting to elevate the temperature of the exhaust gas may include, but is not limited to, one or more of the following: adjusting the beginning of injection (BOI) of the combustion engine 14, adjusting the exhaust gas recirculation (EGR system 64) timing and/or parameters, adjusting the position of the throttle intake valve 58 which may adjust the amount of fuel delivered to the combustion engine, and adjusting the speed of the combustion engine. Then, it may be determined if the exhaust gas, and thus the OC outlet temperature has reached or exceeded the reference temperature 220. The reference temperature may be a temperature where accumulated particulates and hydrocarbon can be oxidized, combusted, or both, in the particulate filter assembly 30 (e.g., light-off temperature of the oxidation catalyst 30). If the reference temperature is reached or exceeded, the real time accumulator may be reset 222, and the combustion engine 14 may be returned to its normal operating conditions. Also, the thermal management system may attempt to lower (i.e., cool) the temperature of the exhaust gas and thus of the OC outlet temperature, or at least manage the temperature increase that otherwise results from the accumulated particulates and hydrocarbon being oxidized, combusted, or both. Attempting to lower the temperature of the exhaust may include, but is not limited to, one or more of the following: adjusting the BOI of the combustion engine 14, adjusting the exhaust gas recirculation (EGR system 64) timing and/or parameters, adjusting the position of the throttle intake valve 58 which may adjust the amount of fuel delivered to the combustion engine, and adjusting the speed of the combustion engine.

If the reference temperature is not reached or exceeded, steps may be taken to protect the particulate filter assembly 224. For example, the combustion engine 14 may be returned to its normal operating conditions where the engine speed is not otherwise at an increased value. Various warning lights on the instrument panel may be turned on, such as the check engine light, and the combustion engine 14 may eventually be shutdown.

The above description of embodiments of the invention is merely exemplary in nature and, thus, variations thereof are not to be regarded as a departure from the spirit and scope of the invention.

What is claimed is:

1. A method of controlling an internal combustion engine system comprising an engine, an exhaust system constructed and arranged to flow exhaust gases from the engine therethrough, the exhaust system comprising an oxidation catalyst upstream of a particulate filter, the particulate filter being constructed and arranged to capture particulates in the exhaust gas, and a doser for injecting hydrocarbons into the exhaust gases, the method comprising:

determining if the exhaust gas temperature exiting the oxidation catalyst is below a first temperature, and if so, starting a real time accumulator to measure the time lapse since the exhaust gas temperature exiting the oxidation catalyst has fallen below the first temperature, determining if an accumulated time as measured by the real time accumulator has exceeded a first time period, and if so, elevating the temperature of the exhaust gas exiting the oxidation catalyst, wherein elevating the temperature of the exhaust gas exiting the oxidation catalyst occurs after the accumulated time has exceeded a second time period.

2. The method as set forth in claim 1 further comprising, if the accumulated time has exceeded the first time period, preventing or stopping dosing.

3. The method as set forth in claim 2 wherein preventing or stopping dosing occurs before elevating the temperature of the exhaust gas exiting the oxidation catalyst.

4. The method as set forth in claim 2 wherein preventing or stopping dosing continues for a predetermined time period after the temperature of the exhaust gas exiting the oxidation catalyst exceeds a reference temperature.

5. The method as set forth in claim 1 wherein elevating the temperature of the exhaust gas exiting the oxidation catalyst occurs until the temperature of the exhaust gas has reached or exceeded a reference temperature.

6. The method as set forth in claim 5 wherein the reference temperature is a light-off temperature of the oxidation catalyst.

7. The method as set forth in claim 5 further comprising resetting the real time accumulator after the temperature of the exhaust gas exiting the oxidation catalyst has reached or exceeded the reference temperature.

8. The method as set forth in claim 1 further comprising temporarily suspending diagnostics that detect temperature increases in the particulate filter.

9. The method as set forth in claim 1 wherein elevating the temperature of the exhaust gas exiting the oxidation catalyst comprises at least one of adjusting the beginning of injection of the engine, adjusting an exhaust gas recirculation system, adjusting the amount of fuel delivered to the engine, and adjusting the speed of the engine.

10. The method as set forth in claim 5 further comprising lowering the temperature of the exhaust gas exiting the oxidation catalyst once the temperature of the exhaust gas has reached or exceeded the reference temperature.

11. The method as set forth in claim 10 wherein lowering the temperature of the exhaust gas exiting the oxidation catalyst comprises at least one of adjusting the beginning of injection of the engine, adjusting an exhaust gas recirculation system, adjusting the amount of fuel delivered to the engine, and adjusting the speed of the engine.

12. The method as set forth in claim 5 further comprising protecting the particulate filter if the temperature of the exhaust gas has not reached or exceeded the reference temperature.

13. A method of operating an internal combustion engine system comprising an engine, an oxidation catalyst, and a particulate filter, the method comprising:

determining if the temperature of exhaust gas exiting the oxidation catalyst is below a first temperature;

measuring the time that the temperature of the exhaust gas exiting the oxidation catalyst is below the first temperature; and determining if the measured time has exceeded a first time period, and if so, preventing or stopping dosing, and elevating the temperature of the exhaust gas exiting the oxidation catalyst, wherein preventing or stopping dosing continues for a predetermined time period after the temperature of the exhaust gas exiting the oxidation catalyst exceeds a reference temperature.

14. A method of controlling an internal combustion engine system comprising an engine, an exhaust system constructed and arranged to flow exhaust gases from the engine therethrough, the exhaust system comprising an oxidation catalyst upstream of a particulate filter, the particulate filter being constructed and arranged to capture particulates in the exhaust gas, and a doser for injecting hydrocarbons into the exhaust gases, the method comprising:

determining if the exhaust gas temperature exiting the oxidation catalyst is below a first temperature, and if so, starting a real time accumulator to measure the time lapse since the exhaust gas temperature exiting the oxidation catalyst has fallen below the first temperature;

determining if an accumulated time as measured by the real time accumulator has exceeded a first time period, and if so, elevating the temperature of the exhaust gas exiting the oxidation catalyst; and temporarily suspending diagnostics that detect temperature increases in the particulate filter.

* * * * *